US010290246B2

(12) United States Patent
Lee et al.

(10) Patent No.: US 10,290,246 B2
(45) Date of Patent: May 14, 2019

(54) DISPLAY APPARATUS AND DRIVING METHOD THEREOF

(71) Applicant: Samsung Display Co., Ltd., Yongin-Si, Gyeonggi-Do (KR)

(72) Inventors: Jongjae Lee, Hwaseong-si (KR); Seokhwan Lee, Seoul (KR); Dae-sik Lee, Hwaseong-si (KR); Seyoung Heo, Yongin-si (KR)

(73) Assignee: Samsung Display Co., Ltd. (KR)

( * ) Notice: Subject to any disclaimer, the term of this patent is extended or adjusted under 35 U.S.C. 154(b) by 205 days.

(21) Appl. No.: 15/498,191

(22) Filed: Apr. 26, 2017

(65) Prior Publication Data

US 2017/0316728 A1 Nov. 2, 2017

(30) Foreign Application Priority Data

Apr. 27, 2016 (KR) ..... 10-2016-0051582

(51) Int. Cl.

| | |
|---|---|
| ***G09G 3/3266*** | (2016.01) |
| ***G09G 3/00*** | (2006.01) |
| ***G09G 3/36*** | (2006.01) |
| ***G09G 3/3225*** | (2016.01) |

(52) U.S. Cl.

CPC ..... *G09G 3/006* (2013.01); *G09G 3/3266* (2013.01); *G09G 3/3677* (2013.01); *G09G 3/3696* (2013.01); *G09G 2310/0289* (2013.01); *G09G 2310/08* (2013.01); *G09G 2330/12* (2013.01)

(58) Field of Classification Search

CPC .. G09G 3/3674–3/3681; G09G 3/3266; G09G 3/3696; G09G 2310/0264; G09G 2310/0289

See application file for complete search history.

(56) References Cited

U.S. PATENT DOCUMENTS

| | | | | |
|---|---|---|---|---|
| 7,808,410 | B2 * | 10/2010 | Kim | H03M 1/002 331/14 |
| 8,692,757 | B2 * | 4/2014 | Bang | G09G 3/3648 345/100 |
| 9,275,591 | B2 * | 3/2016 | Bang | G09G 3/3648 |
| 9,570,027 | B2 * | 2/2017 | Kim | G09G 3/3677 |
| 9,672,087 | B2 * | 6/2017 | Lee | G06F 11/0706 |
| 9,698,675 | B2 * | 7/2017 | Zhang | G09G 3/20 |

(Continued)

FOREIGN PATENT DOCUMENTS

| | | | |
|---|---|---|---|
| KR | 10-2015-0081867 | A | 7/2015 |
| KR | 10-2017-0030725 | A | 3/2017 |

*Primary Examiner* — Patrick F Marinelli

(74) *Attorney, Agent, or Firm* — Innovation Counsel LLP

(57) ABSTRACT

A display apparatus includes a plurality of pixels for receiving a plurality of gate signals, and a plurality of data voltages, a level shifter for receiving a gate driving voltage and a plurality of gate control clocks to generate a plurality of reference clocks, and for generating a plurality of control clocks by delaying the reference clocks by a predetermined time, a gate driver for outputting the gate signals in response to the control clocks, a short circuit protector for sensing a current of each control clock at each falling edge of each gate control clock to detect a static current of the each control clock, and for outputting a shut-down signal based on a count of the static current detection, and a voltage generator for providing the gate driving voltage to the level shifter, and shutting down in response to the shut-down signal.

20 Claims, 13 Drawing Sheets

(56) References Cited

U.S. PATENT DOCUMENTS

| | | | | |
|---|---|---|---|---|
| 9,779,665 | B2 * | 10/2017 | Song | G09G 3/3233 |
| 2009/0256733 | A1 * | 10/2009 | Kim | H03M 1/002 341/136 |
| 2011/0069095 | A1 * | 3/2011 | Kim | G09G 3/342 345/690 |
| 2015/0026506 | A1 * | 1/2015 | Lee | G06F 11/0706 714/3 |
| 2015/0194800 | A1 * | 7/2015 | Kim | G09G 3/3677 361/95 |
| 2015/0372589 | A1 * | 12/2015 | Zhang | G09G 3/20 345/211 |
| 2016/0134285 | A1 * | 5/2016 | Ha | H03K 19/0005 326/30 |
| 2016/0225307 | A1 * | 8/2016 | Yoon | G09G 3/2092 |
| 2016/0240144 | A1 * | 8/2016 | Song | G09G 3/3233 |
| 2017/0301295 | A1 * | 10/2017 | Park | G09G 3/3258 |
| 2017/0316728 | A1 * | 11/2017 | Lee | G09G 3/006 |

* cited by examiner

DISPLAY APPARATUS AND DRIVING METHOD THEREOF

CROSS-REFERENCE TO RELATED APPLICATION

This U.S. non-provisional patent application claims priority under 35 U.S.C. § 119 of Korean Patent Application No. 10-2016-0051582, filed on Apr. 27, 2016, the disclosure of which is hereby incorporated by reference in its entirety.

BACKGROUND

The present disclosure herein relates to a display apparatus and a driving method thereof, and more particularly, to a display apparatus that can detect a short circuit state of a gate driver, and a driving method thereof.

In general, a display apparatus includes a display panel having a plurality of pixels for displaying an image, a gate driver for providing gate signals to the pixels, a data driver for providing data voltages to the pixels, and a timing controller for controlling the gate driver and the data driver.

The gate driver and the data driver may generate the gate signals and the data voltages for driving the pixels by the control of the timing controller. The pixels receive the gate signals through a plurality of gate lines. The pixels further receive the data voltages through a plurality of data lines in response to the gate signals. An image may be displayed by the pixels displaying gradations corresponding to the data voltages.

When the display apparatus is in operation, an overcurrent may flow in the gate driver in the case that lines in the gate driver short-circuit. The overcurrent may overhead and cause a damage to components and devices of the gate driver.

SUMMARY

The present disclosure provides a display apparatus that can shut down a voltage driving unit by detecting a short circuit state of a gate driver, and a driving method thereof.

According to one embodiment of the present disclosure, a display apparatus includes: a plurality of pixels configured to receive a plurality of gate signals, and a plurality of data voltages; a level shifter configured to receive a gate driving voltage and a plurality of gate control clocks to generate a plurality of reference clocks, and configured to delay the reference clocks by a predetermined time period to generate a plurality of control clocks; a gate driver configured to output the gate signals in response to the control clocks; a short circuit protector configured to sense a current of each of the control clocks at each falling edge of each of the gate control clocks to detect a static current of each of the control clocks, and configured to output a shut-down signal based on a count value by counting the detection of the static current; and a voltage generator configured to provide the gate driving voltage to the level shifter, and shut down in response to the shut-sown signal.

In one embodiment, the short circuit protector may output the shut-down signal when the count value is greater than a reference count value.

In one embodiment, a (k+1)-th gate control clock may be a signal that is a k-th gate control clock delayed by a first time period, the k-th gate control clock may have a first period, and the k may be a natural number.

In one embodiment, the period of a k-th reference clock may be set to a second period that is twice of the first period, a rising edge of the k-th reference clock may be synchronously set to a p-th rising edge of the k-th gate control clock, and a falling edge of the k-th reference clock may be synchronously set to a (p+1)-th rising edge of the k-th gate control clock.

In one embodiment, a k-th control clock may be generated by delaying the k-th reference clock by a second time period, and the second time period may be greater than zero, and less than one-fifth of an activated time period of the k-th gate control clock.

In one embodiment, the second time period may be set to 100 ns.

In one embodiment, the level shifter may include: a clock generator configured to receive the gate driving voltage and the gate control clocks to generate the reference clocks; and a clock delayer configured to delay the reference clocks by the second time period to generate the control clocks.

In one embodiment, the short circuit protector may include: a current sensor configured to receive the gate control clocks, and to sense the current of each of the control clocks at the falling edge of corresponding each of the gate control clocks; a static current detector configured to detect the static current in the sensed current; an error counter configured to count the detection of the static current, and to output a short circuit signal when the count value is greater than the reference count value; and a short circuit determiner configured to output the shut-down signal in response to the short circuit signal.

In one embodiment, each of the reference clocks may include: a plurality of reference clock signals generated by the gate control clocks; and a plurality of reference clock bar signals generated by the gate control clocks, and having phases respectively opposite to phases of the reference clock signals, and each of the control clocks may include: a plurality of clock signals generated by delaying the reference clock signals by the second time period; and a plurality of clock bar signals generated by delaying the reference clock bar signals by the second time period.

In one embodiment, the current sensor may sense a current of a k-th clock signal and a current of a k-th clock bar signal at each falling edge of the k-th gate control clock.

In one embodiment, when a count value by counting detection of the static current of at least one of the clock signals and the clock bar signals is greater than the reference count value, the short circuit determiner may output the shut-down signal.

In one embodiment, the error counter may receive a start signal pulse for driving the gate driver, reset the count value in response to the start signal pulse, and perform the counting.

According to one embodiment of the present disclosure, a driving method of a display apparatus includes: generating a plurality of reference clocks using a gate driving voltage and a plurality of gate control clocks; generating a plurality of control clocks by delaying the reference clocks by a predetermined time period; sensing a current of each of the control clocks at each falling edge of corresponding each of the gate control clocks; detecting a static current in the sensed current; counting the detection of the static current when the static current is detected; shutting down a voltage generator for generating the gate driving voltage when the count value is greater than a reference count value; and generating a plurality of gate signals using the control clocks, and applying the gate signals and a plurality of data voltages to pixels, when the count value is less than or equal to the reference count value.

BRIEF DESCRIPTION OF THE FIGURES

The accompanying drawings are included to provide a further understanding of the present disclosure, and are incorporated in and constitute a part of this specification. The drawings illustrate exemplary embodiments of the present disclosure and, together with the description, serve to describe principles of the present disclosure. In the drawings.

DETAILED DESCRIPTION

Figure 1:
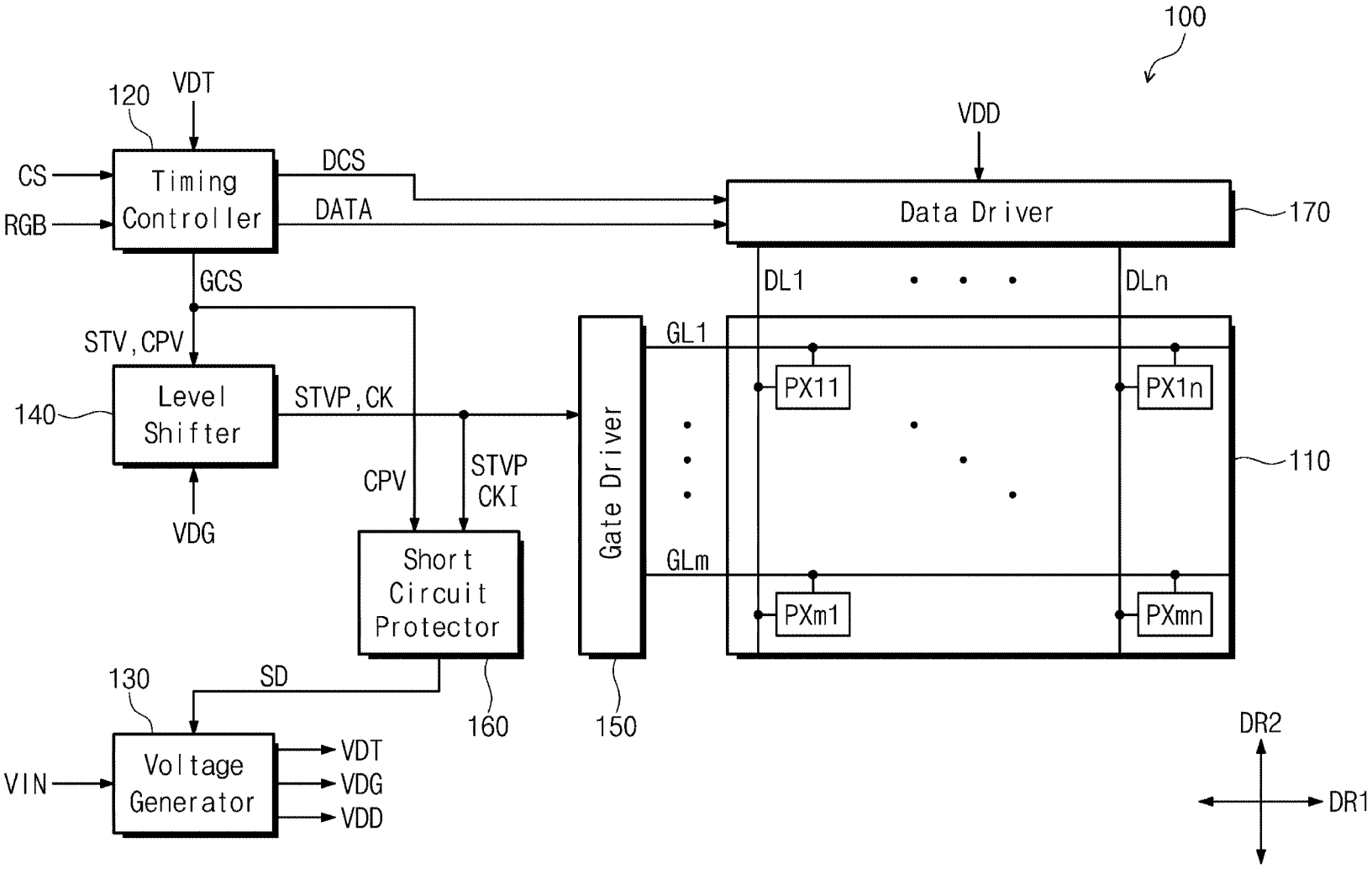
FIG. 1 is a block diagram illustrating a display apparatus, according to one embodiment of the present disclosure.

Exemplary embodiments of the present disclosure will be described below in more detail with reference to the accompanying drawings to clarify benefit, characteristics, and how to achieve the same. The present disclosure may, however, be embodied in different forms and should not be construed as limited to the embodiments set forth herein. Rather, these embodiments are provided so that the present disclosure will be thorough and complete, and will fully convey the scope of the present disclosure to those skilled in the art. The scope of the present disclosure may be defined by the following claims or the equivalents. Like reference numerals refer to like elements throughout this specification.

It will be understood that when an element or layer is referred to as being "on" another element or layer, it can be directly on the other element or layer, or one or more intervening elements, or layers may be present. On the other hand, it will be understood that when an element or layer is referred to as being "directly on" another element or layer, no intervening elements, or layers may be present. As used herein, the term "and/or" includes any and all combinations of one or more of the associated listed items.

Spatially relative terms, such as "below", "beneath", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. Like reference numerals refer to like elements throughout this specification.

It will be understood that, although the terms first, second, etc. may be used herein to describe various elements, components, and/or sections, these elements, components, and/or sections should not be limited by these terms. These terms are only used to distinguish one element, component, or section from another element, component, or section. Thus, a first element, component, or section discussed below could be termed a second element, component, or section without departing from the teachings of the present disclosure.

Exemplary embodiments of the present disclosure will be described with reference to schematic views such as a plan view and a cross-sectional view. The shape and size of an exemplary view may be modified by manufacturing techniques, allowable errors, or the like. Thus, exemplary embodiments of the present disclosure are not limited to specific shapes illustrated, but include modifications of shape and size produced according to manufacturing process. Therefore, the regions illustrated in the figures have schematic attributes, and the shapes and sizes of the regions illustrated in the figures are intended to illustrate specific shapes and sizes of regions of the elements and are not intended to limit the scope of the present disclosure.

Hereinafter, exemplary embodiments of the present disclosure will be described below in more detail with reference to the accompanying drawings.

FIG. 1 is a block diagram illustrating a display apparatus, according to one embodiment of the present disclosure.

Referring to FIG. 1, a display apparatus 100 includes a display panel 110, a timing controller 120, a voltage generator 130, a level shifter 140, a gate driver 150, a short circuit protector 160, and a data driver 170.

The display panel 110 may be a liquid crystal display panel including two substrates facing each other, and a liquid crystal layer disposed between the two substrates. However, the display panel 110 is not limited thereto, but may be an organic light-emitting display panel having organic light-emitting devices, an electrophoretic display panel having an electrophoretic layer, or an electrowetting display panel having an electrowetting layer.

The display panel 110 includes a plurality of gate lines GL1 to GLm, a plurality of data lines DL1 to DLn, and a plurality of pixels PX11 to PXmn. m and n are natural numbers. The gate lines GL1 to GLm extend in a first direction DR1 and are connected to the gate driver 150. The data lines DL1 to DLn extend in a second direction DR2 crossing the first direction DR1 and are connected to the data driver 170.

The pixels PX11 to PXmn are arranged in regions divided by the gate lines GL1 to GLm and the data lines DL1 to DLn crossing each other. Accordingly, the pixels PX11 to PXmn may be arranged in m rows and n columns in a matrix form. The pixels PX11 to PXmn are connected to the gate lines GL1 to GLm and the data lines DL1 to DLn.

The pixels PX11 to PXmn may display red, green, or blue color. The pixels PX11 to PXmn are not limited thereto, but may further display various colors such as white, yellow, cyan, and magenta.

The timing controller 120 may be mounted on a printed circuit board (not illustrated) in the form of an integrated circuit chip. The timing controller 120 receives a plurality of image signals RGB, and a control signal CS from the outside (for example, a system board).

The image signals RGB may include red image signals, green image signals, and blue image signals. The control signal CS may include a vertical synchronization signal that is a frame distinction signal, a horizontal synchronization signal that is a row distinction signal, a data enable signal having a high level only for a time period for which data are outputted so as to indicate a zone in which the data come in, and a main clock signal.

The timing controller 120 converts a data format of the image signals RGB so as to conform to an interface specification between the timing controller 120 and the data driver 170. The timing controller 120 provides a plurality of image data DATA with the converted data format to the data driver 170.

The timing controller 120 generates a gate control signal GCS and a data control signal DCS in response to the control signal CS. The gate control signal GCS is a control signal for controlling operation timing of the gate driver 150. The data control signal DCS is a control signal for controlling operation timing of the data driver 170.

The gate control signal GCS may include a gate start signal STV for providing notification of a start of scanning, and a plurality of gate control clocks CPV for generating a plurality of control clocks CK.

The data control signal DCS may include a horizontal start signal for providing notification of a start of transmission of the image data DATA to the data driver 170, a load signal that is a command signal for commanding data voltages to be applied to the data lines DL1 to DLn, and a polarity control signal for determining a polarity of the data voltages with respect to a common voltage.

The timing controller 120 provides the gate control signal GCS to the level shifter 140, and the data control signal DCS to the data driver 170. The timing controller 120 provides the gate control clocks CPV of the gate control signal GCS to the short circuit protector 160.

The voltage generator 130 may generate, using an input voltage VIN provided from the outside, a timing controller driving voltage VDT for driving the timing controller 120, a gate driving voltage VDG for driving the level shifter 140, and a data driving voltage VDD for driving the data driver 170.

The timing controller driving voltage VDT is provided to the timing controller 120, the gate driving voltage VDG is provided to the level shifter 140, and the data driving voltage VDD is provided to the data driver 170.

The gate driving voltage VDG may include a gate-on voltage and a gate-off voltage. The level shifter 140 generates the control clocks CK and a start signal pulse STVP having levels of the gate-on voltage and the gate-off voltage in response to the gate control signal GCS and the gate driving voltage VDG. The control clocks CK may include a plurality of clock signals, and a plurality of clock bar signals having phases respectively opposite to those of the clock signals.

The level shifter 140 generates the start signal pulse STVP using the gate start signal STV, and generates the control clocks CK using the gate control clocks CPV. The level shifter 140 provides the start signal pulse STVP and the control clocks CK to the gate driver 150.

The gate driver 150 may generate a plurality of gate signals in response to the start signal pulse STVP and the control clocks CK. The gate signals may be sequentially provided to the pixels PX11 to PXmn through the gate lines GL1 to GLm.

The gate start signal STV is a signal for providing notification of a start of a frame, and the start signal pulse STVP is a signal for driving the gate driver 150 when the frame starts. The gate driver 150 may include multiple stages for generating the gate signals, the start signal pulse STVP may drive a first stage, and each of the rest of stages may receive a gate signal of a previous stage.

The data driver 170 may generate a plurality of the data voltages having an analog form corresponding to the image data DATA in response to the data driving voltage VDD and the data control signal DCS. The data voltages are provided to the pixels PX11 to PXmn through the data lines DL1 to DLn.

The gate driver 150 and the data driver 170 may include a plurality of driving chips and mounted on a flexible printed circuit board, and may be connected to the display panel 110 by a tape carrier package (TCP) technique. The gate driver 150 and the data driver 170 are not limited thereto, but may include a plurality of driving chips and be mounted on the display panel 110 by a chip on glass (COG) technique.

Alternatively, the gate driver 150 may be formed simultaneously with transistors of the pixels PX11 to PXmn, and be mounted on the display panel 110 in the form of an amorphous silicon TFT gate driver circuit (ASG), or an oxide silicon TFT gate driver circuit (OSG).

Although not illustrated, in the case that the display panel 110 is the liquid crystal display panel, the display apparatus 100 may further include a backlight unit disposed in the rear of the display panel 110. The backlight unit may generate light, and provide the light to the display panel 110. The display panel 110 may display an image using the light provided by the backlight unit.

The pixels PX11 to PXmn receive the data voltages through the data lines DL1 to DLn in response to the gate signals received through the gate lines GL1 to GLm. The pixels PX11 to PXmn may display gradations corresponding to the data voltages to display an image.

The short circuit protector 160 senses a current CKI of each of the control clocks CK at each falling edge of the corresponding gate control clocks CPV. When a static current is detected in the sensed current CM, the short circuit protector 160 counts the detection of the static current. When the count value is greater than a reference count value, the short circuit protector 160 generates a shut-down signal SD, and provides the shut-down signal SD to the voltage generator 130.

When one or more lines of the gate driver 150 receiving the control clocks CK short-circuit, a static current having a direct current component with a predetermined level may flow in the lines. The static current flowing in the lines may be detected by sensing a current of the control clocks CK. However, an external factor may cause a static current to flow in the gate driver 150. For example, the static current may flow in the gate driver 150 by static electricity, lightning, or the like.

The reference count value may be set by a user, and be a minimum count value for detecting a short circuit state of the lines other than the external factor. For example, when the count value is greater than the reference count value, it may be determined that a short circuit has occurred in the gate driver 150.

The voltage generator 130 becomes shut down in response to the shut-down signal SD provided by the short circuit protector 160. The voltage generator 130 that is shut down does not generate driving voltages VDT, VDG, and VDD. Accordingly, the level shifter 140 is not driven, and the control clocks CK are not provided to the gate driver 150. When the count value is less than or equal to the reference count value, the control clocks CK may normally be provided to the gate driver 150.

An operation that the short circuit protector 160 counts detection of a static current may be performed every frame. For example, the short circuit protector 160 receives the start signal pulse STVP from the level shifter 140. When the start signal pulse STVP is provided to the short circuit protector 160, the short circuit protector 160 may reset the count value, and perform counting again. The operation of counting may be performed until a next start signal pulse is received.

When the lines within the gate driver 150 short-circuit, an overcurrent may flow in the gate driver 150. In one embodiment of the present disclosure, a static current of the control clocks CK provided to the gate driver 150 may be measured to detect the short circuit state of the gate driver 150. When the gate driver 150 is determined to be in the short circuit state, the voltage generator 130 may be shut down, and thus the gate driver 150 may cease to operate, thereby preventing damage to components and devices of the display apparatus 100.

Figure 2:
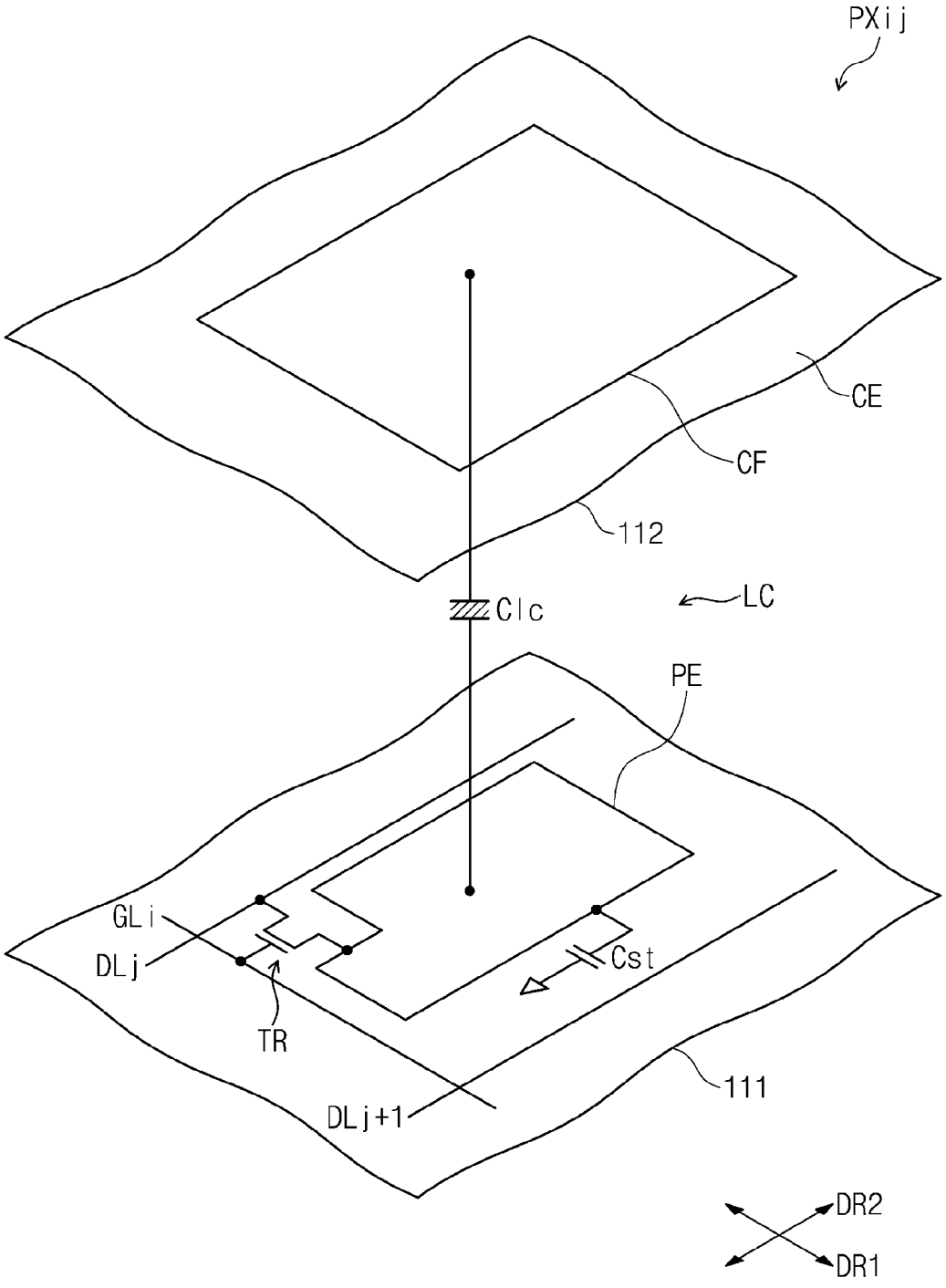
FIG. 2 is an equivalent circuit diagram illustrating a pixel illustrated in FIG. 1.

FIG. 2 is an equivalent circuit diagram illustrating a pixel illustrated in FIG. 1.

For ease of description, a pixel PXij connected to a gate line GLi and a data line DLj is illustrated in FIG. 2. Although not illustrated, a configuration of other pixels PX of the display panel 110 will be identical to that of the pixel PXij illustrated in FIG. 2.

Referring to FIG. 2, the display panel 110 includes a first substrate 111, a second substrate 112 facing the first substrate 111, and a liquid crystal layer LC disposed between the first substrate 111 and the second substrate 112.

The pixel PXij includes a transistor TR connected to the gate line GLi and the data line DLj, a liquid crystal capacitor Clc connected to the transistor TR, and a storage capacitor Cst connected in parallel to the liquid crystal capacitor Clc. The storage capacitor Cst may be omitted in some embodiments.

The transistor TR may be disposed in the first substrate 111. The transistor TR includes a gate electrode connected to the gate line GLi, a source electrode connected to the data line DLj, and a drain electrode connected to the liquid crystal capacitor Clc and the storage capacitor Cst.

The liquid crystal capacitor Clc includes a pixel electrode PE disposed in the first substrate 111, a common electrode CE disposed in the second substrate 112, and the liquid crystal layer LC disposed between the pixel electrode PE and the common electrode CE. The liquid crystal layer LC functions as a dielectric. The pixel electrode PE is connected to the drain electrode of the transistor TR.

In FIG. 2, the pixel electrode PE has a non-slit structure, but is not limited thereto, and the pixel electrode PE may have a slit structure including a cross-shaped base line and a plurality of branches extending radially from the base line.

The common electrode CE may be disposed entirely in the second substrate 112. However, the common electrode CE is not limited thereto, and may be disposed in the first substrate 111. In this case, at least one of the pixel electrode PE and the common electrode CE may include a slit.

The storage capacitor Cst may include the pixel electrode PE, a storage electrode (not illustrated) diverging from a storage line (not illustrated), and an insulation layer disposed between the pixel electrode PE and the storage electrode. The storage line may be disposed in the first substrate 111, and be simultaneously formed in the same layer as that of the gate lines GL1 to GLm. The storage electrode may partly overlap the pixel electrode PE.

The pixel PXij may further include a color filter CF representing one of red, green, and blue colors. As an exemplary embodiment, the color filter CF may be disposed in the second substrate 112 as illustrated in FIG. 2. However, the color filter CF is not limited thereto, but may be disposed in the first substrate 111.

The transistor TR is turned on in response to a gate signal provided through the gate line GLi. A data voltage received through the data line DLj is provided to the pixel electrode PE of the liquid crystal capacitor Clc through the turned-on transistor TR. The common voltage is applied to the common electrode CE.

An electric field is generated between the pixel electrode PE and the common electrode CE by a voltage level difference between the data voltage and the common voltage. Liquid crystal molecules of the liquid crystal layer LC are driven by the electric field generated between the pixel electrode PE and the common electrode CE. Transmittance of light may be adjusted by the liquid crystal molecules driven by the electric field to display an image.

A storage voltage with a constant voltage level may be applied to the storage line. However, the storage line is not limited thereto, but the common voltage may be applied to the storage line. The storage capacitor Cst functions to complement a voltage charged in the liquid crystal capacitor Clc.

Figure 3:
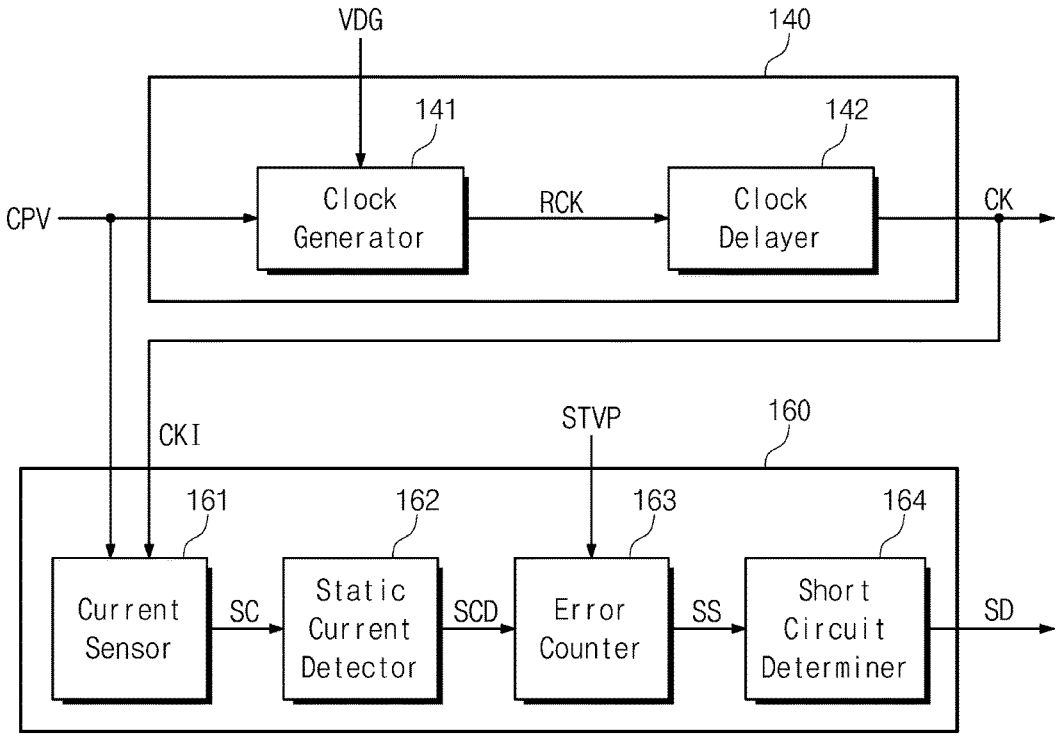
FIG. 3 is a block diagram illustrating a level shifter and a short circuit protector illustrated in FIG. 1.

FIG. 3 is a block diagram illustrating a level shifter and a short circuit protector illustrated in FIG. 1.

Referring to FIG. 3, the level shifter 140 includes a clock generator 141, and a clock delayer 142, and the short circuit protector 160 includes a current sensor 161, a static current detector 162, an error counter 163, and a short circuit determiner 164.

A configuration of the level shifter 140 illustrated in FIG. 3 is for generating the control clocks CK. The clock generator 141 receives the gate driving voltage VDG and the gate control clocks CPV, and generates reference clocks RCK using the gate driving voltage VDG and the gate control clocks CPV.

The clock delayer 142 receives the reference clocks RCK from the clock generator 141, and delays the reference clocks RCK by a predetermined time period so as to output as the control clocks CK. The control clocks CK are provided to the gate driver 150. Timing of the reference clocks RCK and the control clocks CK will be described in detail in FIGS. 5 and 6 later.

The current sensor 161 receives the gate control clocks CPV, and senses the current CM of each of the control clocks CK at each falling edge of the corresponding gate control clocks CPV. The sensed current CM of each of the control clocks CK is provided to the static current detector 162 as a sensed current SC. The static current detector 162 determines whether the sensed current SC is a static current, and when the static current is detected, provides a static current detection result SCD to the error counter 163.

The error counter 163 receives the static current detection result SCD from the static current detector 162 to count the detection of the static current, and when the count value is greater than the reference count value, generates and outputs a short circuit signal SS. For example, the error counter 163 may output the short circuit signal SS having a high level when the count value is greater than the reference count value. The error counter 163 may reset the count value in response to the start signal pulse STVP, and perform the counting again.

An operation of detecting the current CKI of each of the control clocks CK at the falling edge of the corresponding gate control clocks CPV, and the static current will be described in detail with reference to timing diagrams illustrated in FIGS. 9 and 11 below.

The short circuit determiner 164 receives the short circuit signal SS from the error counter 163, and generates and outputs the shut-down signal SD in response to the short circuit signal SS. As described above, the shut-down signal SD is provided to the voltage generator 130.

Figure 4:
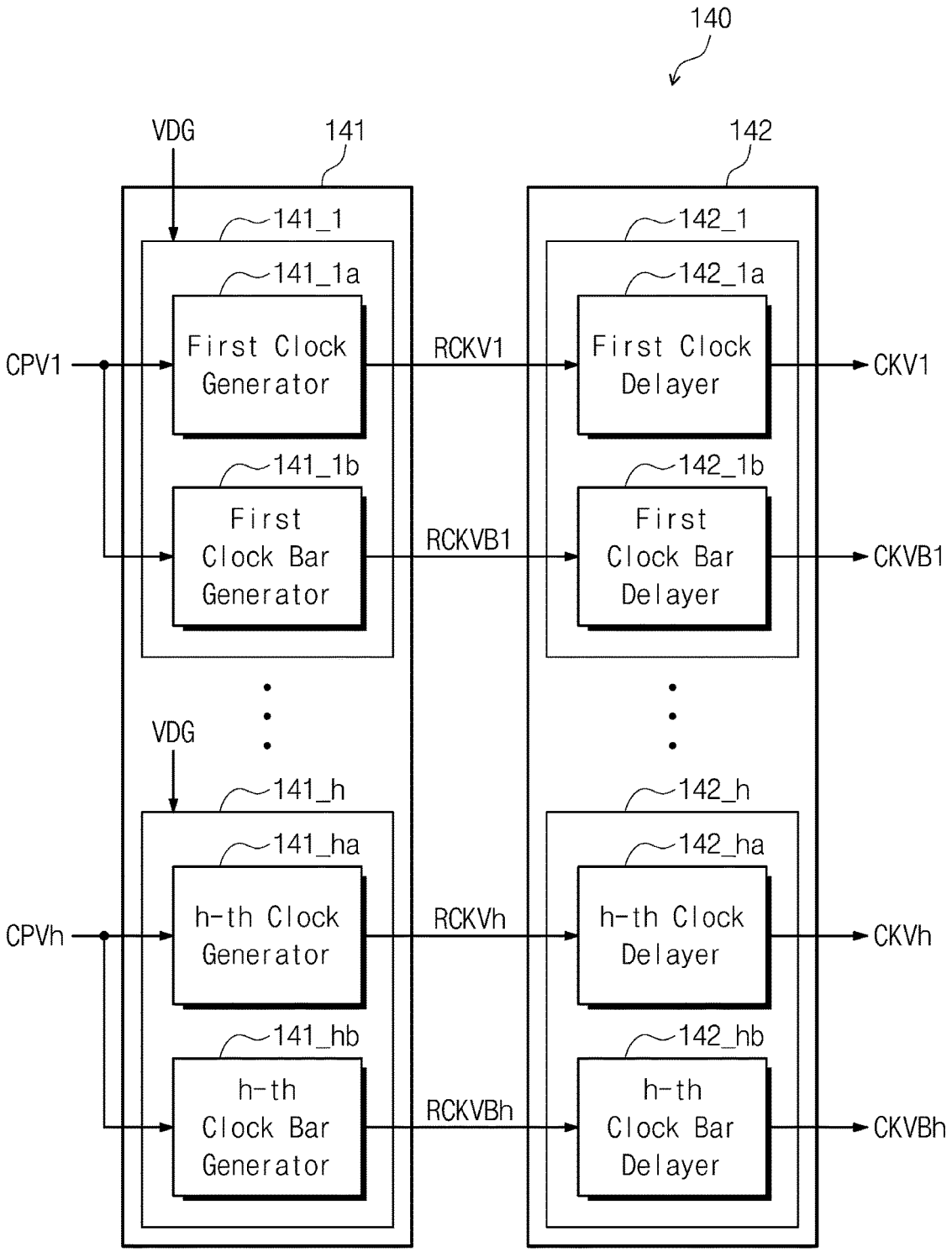
FIG. 4 is a block diagram illustrating a clock generator and a clock delayer illustrated in FIG. 3.

FIG. 4 is a block diagram illustrating a clock generator and a clock delayer illustrated in FIG. 3.

Referring to FIG. 4, the gate control clocks CPV may include a plurality of first to h-th gate control clocks CPV1 to CPVh. h is a natural number. The clock generator 141 includes a plurality of first to h-th clock generating circuits 141_1 to 141_h for receiving the first to h-th gate control clocks CPV1 to CPVh respectively. The first to h-th gate control clocks CPV1 to CPVh are applied to the first to h-th clock generating circuits 141_1 to 141_h with one-to-one correspondence relations.

The first to h-th clock generating circuits 141_1 to 141_h respectively include a plurality of first to h-th clock generators 141_1*a* to 141_ha, and a plurality of first to h-th clock bar generators 141_1*b* to 141_hb. The reference clocks RCK include a plurality of first to h-th reference clock signals RCKV1 to RCKVh, and a plurality of first to h-th reference clock bar signals RCKVB1 to RCKVBh having phases respectively opposite to those of the first to h-th reference clock signals RCKV1 to RCKVh.

The gate driving voltage VDG provided to the first to h-th clock generating circuits 141_1 to 141_h is provided to both of the first to h-th clock generators 141_1*a* to 141_ha, and the first to h-th clock bar generators 141_1*b* to 141_hb.

The first to h-th clock generators 141_1*a* to 141_ha receive the gate driving voltage VDG and the first to h-th gate control clocks CPV1 to CPVh, and generate the first to h-th reference clock signals RCKV1 to RCKVh using the gate driving voltage VDG and the first to h-th gate control clocks CPV1 to CPVh.

The first to h-th clock bar generators 141_1*b* to 141_hb receive the gate driving voltage VDG and the first to h-th gate control clocks CPV1 to CPVh, and generate the first to h-th reference clock bar signals RCKVB1 to RCKVBh having phases respectively opposite to those of the first to h-th reference clock signals RCKV1 to RCKVh using the gate driving voltage VDG and the first to h-th gate control clocks CPV1 to CPVh.

Each of the first to h-th clock generating circuits 141_1 to 141_h includes a pair of a clock generator and a clock bar generator. For example, the k-th clock generating circuit includes the k-th clock generator for receiving the k-th gate control clock to generate the k-th reference clock signal, and the k-th clock bar generator for receiving the k-th gate control clock to generate the k-th reference clock bar signal. k is a natural number.

The clock delayer 142 includes a plurality of first to h-th clock delay circuits 142_1 to 142_h arranged to have one-to-one correspondence relations with the first to h-th clock generating circuits 141_1 to 141_h. The first to h-th clock delay circuits 142_1 to 142_h include a plurality of first to h-th clock delayers 142_1*a* to 142_ha, and a plurality of first to h-th clock bar delayers 142_1*b* to 142_hb.

The control clocks CK include a plurality of first to h-th clock signals CKV1 to CKVh, and a plurality of first to h-th clock bar signals CKVB1 to CKVBh having phases respectively opposite to those of the first to h-th clock signals CKV1 to CKVh.

The first to h-th clock delayers 142_1*a* to 142_ha receive the first to h-th reference clock signals RCKV1 to RCKVh, and generate the first to h-th clock signals CKV1 to CKVh by delaying the received first to h-th reference clock signals RCKV1 to RCKVh by a predetermined time period. The first to h-th reference clock signals RCKV1 to RCKVh are applied to the first to h-th clock delayers 142_1*a* to 142_ha with one-to-one correspondence relations.

The first to h-th clock bar delayers 142_1*b* to 142_hb receive the first to h-th reference clock bar signals RCKVB1 to RCKVBh, and generate the first to h-th clock bar signals CKVB1 to CKVBh by delaying the received first to h-th reference clock bar signals RCKVB1 to RCKVBh by a predetermined time period. The first to h-th reference clock bar signals RCKVB1 to RCKVBh are applied to the first to h-th clock bar delayers 142_1*b* to 142_hb with one-to-one correspondence relations.

Each of the first to h-th clock delay circuits 142_1 to 142_h includes a pair of a clock delayer and a clock bar delayer. For example, the k-th clock delay circuit includes the k-th clock delayer for receiving the k-th reference clock signal to generate the k-th clock signal, and the k-th clock bar delayer for receiving the k-th reference clock bar signal to generate the k-th clock bar signal.

Figure 5:
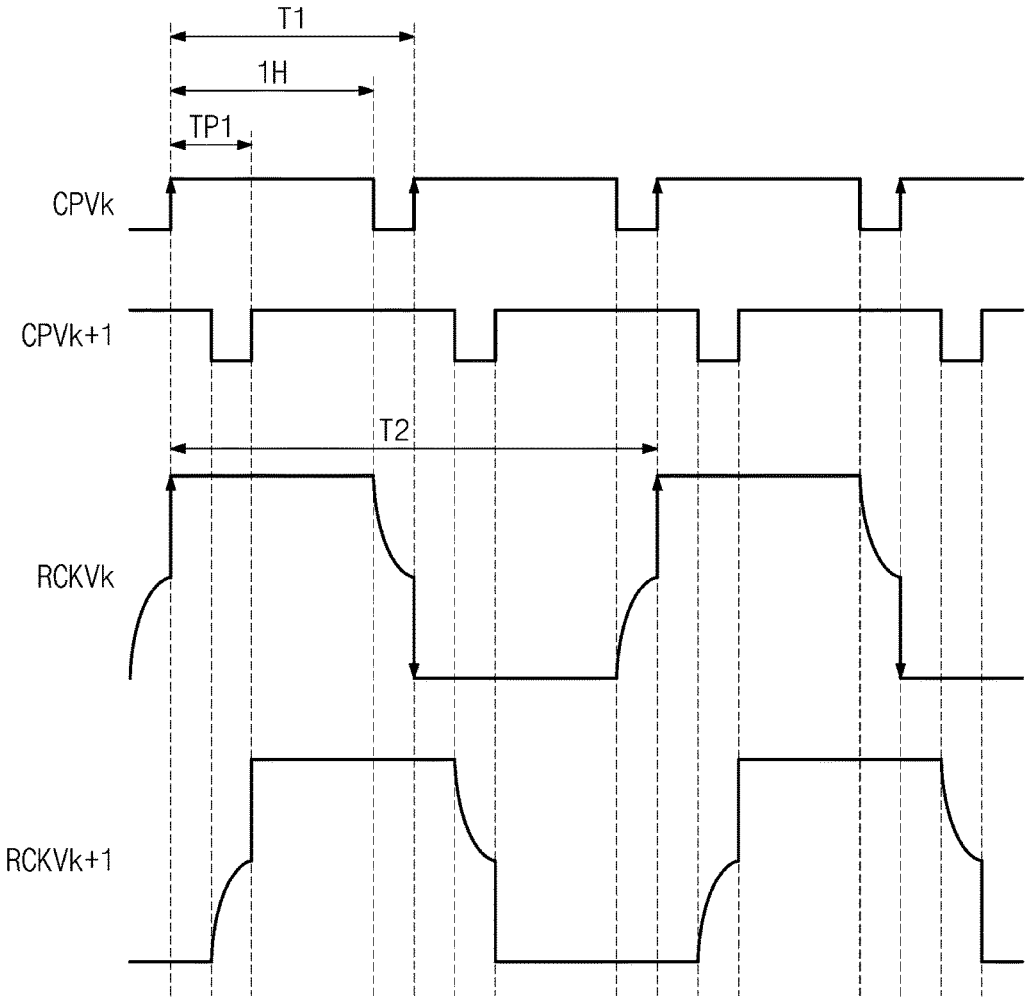
FIG. 5 is a timing diagram of reference clock signals generated in the clock generator illustrated in FIG. 3.
Figure 6:
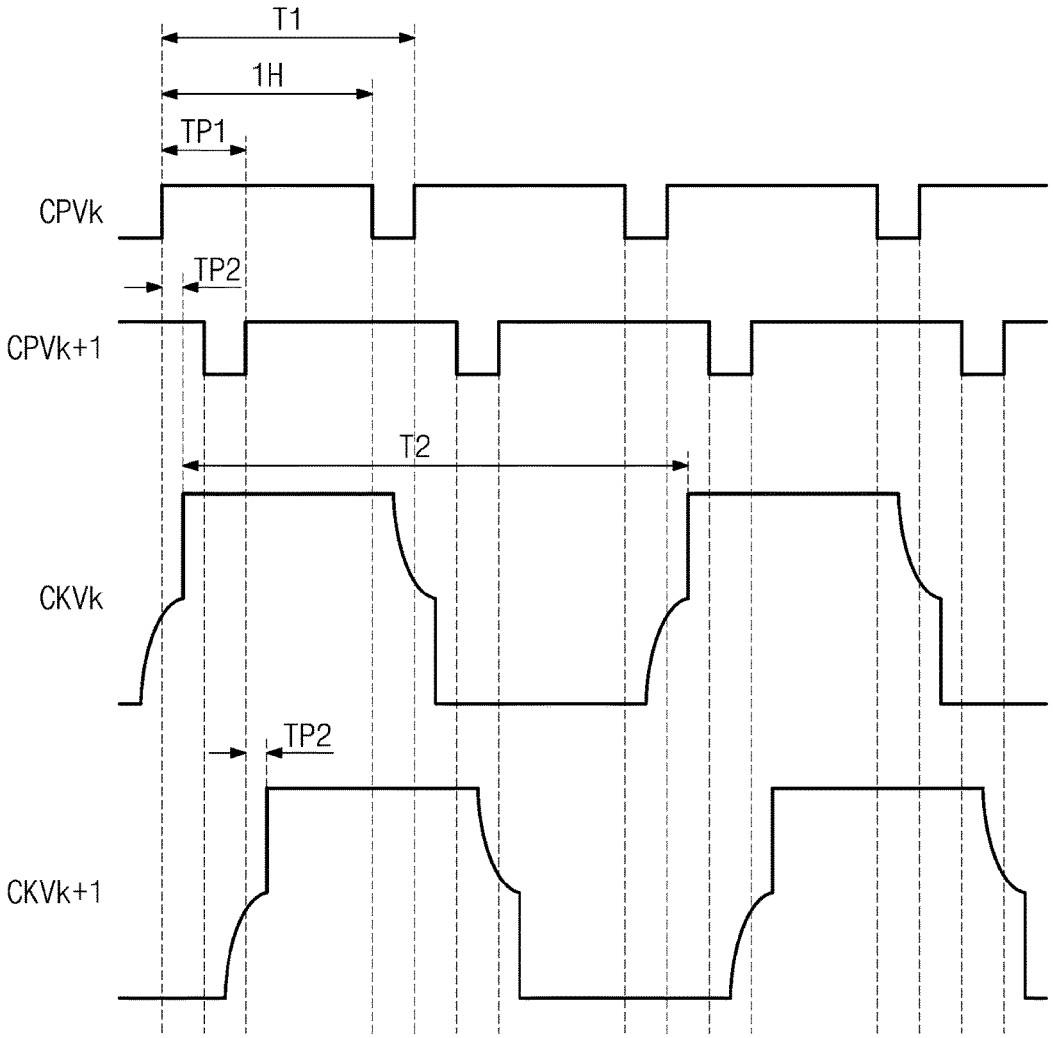
FIG. 6 is a timing diagram of clock signals generated in the clock delayer illustrated in FIG. 3.

FIG. 5 is a timing diagram of reference clock signals generated in the clock generator illustrated in FIG. 3. FIG. 6 is a timing diagram of the clock signals generated in the clock delayer illustrated in FIG. 3.

In FIG. 5, the k-th and (k+1)-th reference clock signals RCKVk and RCKVk+1 are generated respectively in the k-th clock generator and the (k+1)-th clock generator among the first to h-th clock generators 141_1*a* to 141_ha illustrated in FIG. 4.

In FIG. 6, the k-th and (k+1)-th clock signals CKVk and CKVk+1 are generated respectively in the k-th clock delayer and the (k+1)-th clock delayer among the first to h-th clock delayers 142_1*a* to 142_ha illustrated in FIG. 4.

Referring to FIG. 5, each of the k-th gate control clock CPVk and the (k+1)-th gate control clock CPVk+1 has a first period T1, and an identical activated time period 1H. The activated time period 1H may be defined as a time period for which a high level is maintained for the first period T1. The (k+1)-th gate control clock CPVk+1 is a signal delayed by a first time period TP1 with respect to the k-th gate control clock CPVk.

Accordingly, a rising edge of the (k+1)-th gate control clock CPVk+1 is set to a point of time delayed by the first time period TP1 with respect to a rising edge of the k-th gate control clock CPVk. The first time period TP1 is set to be less than the activated time period 1H.

The k-th reference clock signal RCKVk is generated by the k-th gate control clock CPVk, and the (k+1)-th reference clock signal RCKVk+1 is generated by the (k+1)-th gate control clock CPVk+1. The period of each of the k-th and (k+1)-th reference clock signals RCKVk and RCKVk+1 is set to a second period T2 that is twice of the first period T1.

A rising edge of the k-th reference clock signal RCKVk is synchronously set to one rising edge (e.g., p-th rising edge) of the k-th gate control clock CPVk, and a falling edge of the k-th reference clock signal RCKVk is synchronously set to the next rising edge (e.g., (p+1)-th rising edge) of the k-th gate control clock CPVk. Accordingly, one period of the k-th reference clock signal RCKVk overlaps two periods of the k-th gate control clock CPVk.

The (k+1)-th reference clock signal RCKVk+1 generated by the (k+1)-th gate control clock CPVk+1 is generated in the same manner as that for the k-th reference clock signal RCKVk, and thus description thereof will not be given.

Referring to FIG. 6, the k-th and (k+1)-th clock signals CKVk and CKVk+1 are generated by delaying respectively the k-th and (k+1)-th reference clock signals RCKVk and RCKVk+1 by a second time period TP2. The second time period TP2 may be greater than zero, and less than one-fifth of the activated time period 1H. For example, the second time period TP2 may be set to 100 ns.

Although not illustrated, other clock signals may also be generated by other gate control clocks in the same or substantially similar manner, and the first to h-th clock bar signals CKVB1 to CKVBh may be generated to have phases respectively opposite to those of the first to h-th clock signals CKV1 to CKVh.

Figure 7:
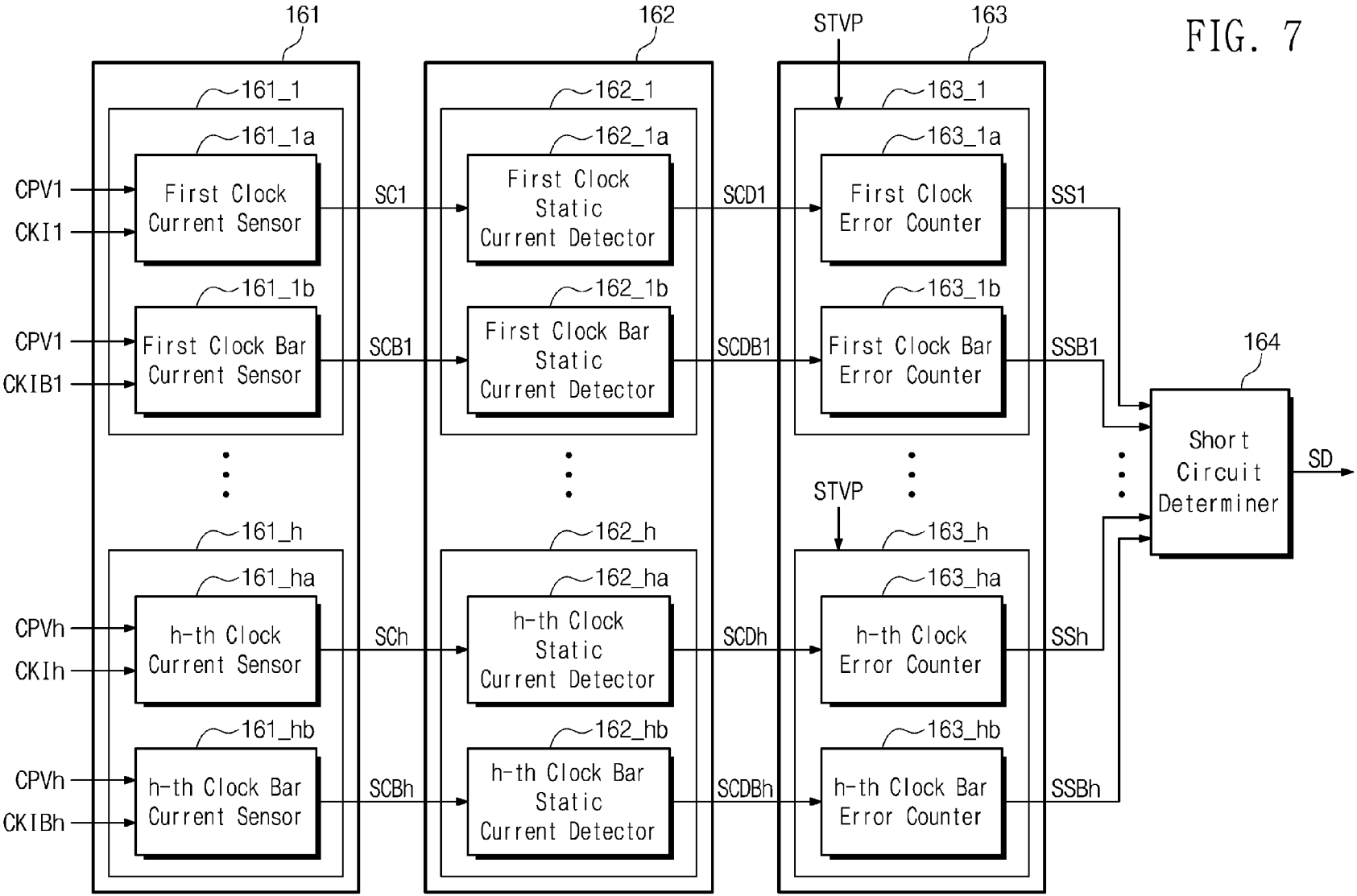
FIG. 7 is a block diagram illustrating a current sensor, a static current detector, and an error counter illustrated in FIG. 3.

FIG. 7 is a block diagram illustrating a current sensor, a static current detector, and an error counter illustrated in FIG. 3.

Referring to FIG. 7, the current sensor 161 includes a plurality of first to h-th current sensing circuits 161_1 to 161_h for receiving the first to h-th gate control clocks CPV1 to CPVh respectively. The first to h-th gate control clocks CPV1 to CPVh are applied to the first to h-th current sensing circuits 161_1 to 161_h with one-to-one correspondence relations.

The first to h-th current sensing circuits 161_1 to 161_h respectively include a plurality of first to h-th clock current sensors 161_1*a* to 161_ha, and a plurality of first to h-th clock bar current sensors 161_1*b* to 161_hb.

The first to h-th clock current sensors 161_1*a* to 161_ha receive the first to h-th gate control clocks CPV1 to CPVh respectively, and sense first to h-th clock currents CKI1 to CKIh of the first to h-th clock signals CKV1 to CKVh at each falling edge of the first to h-th gate control clocks CPV1 to CPVh. The sensed first to h-th clock currents CKI1 to CKIh are provided to the static current detector 162 as first to h-th clock sensed currents SC1 to SCh.

The first to h-th clock bar current sensors 161_1*b* to 161_hb receive the first to h-th gate control clocks CPV1 to CPVh respectively, and sense first to h-th clock bar currents CKIB1 to CKIBh of the first to h-th clock bar signals CKVB1 to CKVBh at each falling edge of the first to h-th gate control clocks CPV1 to CPVh. The sensed first to h-th clock bar currents CKIB1 to CKIBh are provided to the static current detector 162 as first to h-th clock bar sensed currents SCB1 to SCBh.

Each of the first to h-th current sensing circuits 161_1 to 161_h includes a pair of a clock current sensor and a clock bar current sensor. For example, the k-th current sensing circuit includes the k-th clock current sensor for sensing a current of the k-th clock signal at each falling edge of the k-th gate control clock, and the k-th clock bar current sensor for sensing a current of the k-th clock bar signal at each falling edge of the k-th gate control clock.

The static current detector 162 includes a plurality of first to h-th static current detecting circuits 162_1 to 162_h arranged to have one-to-one correspondence relations with the first to h-th current sensing circuits 161_1 to 161_h. The first to h-th static current detecting circuits 162_1 to 162_h respectively include a plurality of first to h-th clock static current detectors 162_1*a* to 162_ha, and a plurality of first to h-th clock bar static current detectors 162_1*b* to 162_hb.

The first to h-th clock static current detectors 162_1*a* to 162_ha determine respectively whether the first to h-th clock sensed currents SC1 to SCh are a static current. When the static current is detected, the first to h-th clock static current detectors 162_1*a* to 162_ha provide first to h-th clock static current detection results SCD1 to SCDh to the error counter 163 as static current detection results.

The first to h-th clock bar static current detectors 162_1*b* to 162_hb determine respectively whether the first to h-th clock bar sensed currents SCB1 to SCBh are a static current. When the static current is detected, the first to h-th clock bar static current detectors 162_1*b* to 162_hb provide first to h-th clock bar static current detection results SCDB1 to SCDBh to the error counter 163 as static current detection results.

Each of the first to h-th static current detecting circuits 162_1 to 162_h includes a pair of a clock static current detector and a clock bar static current detector. For example, the k-th static current detecting circuit includes the k-th clock static current detector for determining whether the k-th clock sensed current is a static current, and the k-th clock bar static current detector for determining whether the k-th clock bar sensed current is the static current.

The error counter 163 includes first to h-th error counter circuits 163_1 to 163_h arranged to have one-to-one correspondence relations with the first to h-th static current detecting circuits 162_1 to 162_h. The first to h-th error counter circuits 163_1 to 163_h respectively include a plurality of first to h-th clock error counters 163_1*a* to 163_ha, and a plurality of first to h-th clock bar error counters 163_1*b* to 163_hb.

The first to h-th clock error counters 163_1*a* to 163_ha respectively receive the first to h-th clock static current detection results SCD1 to SCDh to count the detection of the static current. When the count value is greater than the reference count value, each of the first to h-th clock error counters 163_1*a* to 163_ha outputs the short circuit signal SS1 to SSh.

The first to h-th clock bar error counters 163_1*b* to 163_hb respectively receive the first to h-th clock bar static current detection results SCDB1 to SCDBh to count the detection of the static current. When the count value is greater than the reference count value, each of the first to h-th clock bar error counters 163_1*b* to 163_hb outputs the short circuit signal SSB1 to SSBh.

The start signal pulse STVP is provided to the first to h-th clock error counters 163_1*a* to 163_ha, and the first to h-th clock bar error counters 163_1*b* to 163_hb. The first to h-th clock error counters 163_1*a* to 163_ha, and the first to h-th clock bar error counters 163_1*b* to 163_hb may reset the count value in response to the start signal pulse STVP, and perform the counting again.

The short circuit signals SS outputted from the first to h-th clock error counters 163_1*a* to 163_ha, and the first to h-th clock bar error counters 163_1*b* to 163_hb are provided to the short circuit determiner 164. The short circuit determiner 164 may be an OR gate logic circuit. Accordingly, when receiving at least one short circuit signal SS among the short circuit signals SS1 to SS1*h* and SSB1 to SSBh, the short circuit determiner 164 may provide the shut-down signal SD to the voltage generator 130 in response to the short circuit signal SS.

Figure 8:
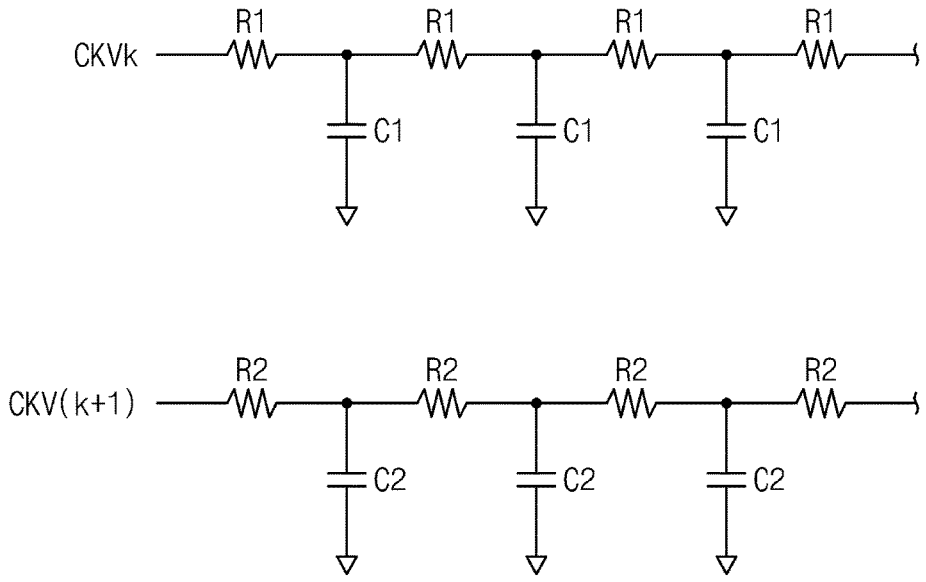
FIG. 8 illustrates an internal equivalent circuit including resistors and capacitors of a gate driver illustrated in FIG. 1.

FIG. 8 illustrates an internal equivalent circuit including resistors and capacitors of the gate driver illustrated in FIG. 1. FIG. 9 is a timing diagram of the clock signals applied to the gate driver illustrated in FIG. 8 in a normal state.

The equivalent circuit of a portion of the gate driver receiving the k-th and (k+1)-th clock signals CKVk and CKVk+1 is illustrated in FIG. 8 by way of example. For ease of description, a signal waveform of each of the k-th and (k+1)-th clock signals CKVk and CKVk+1 is illustrated in a dotted line, and the respective currents CKIk and CKIk+1 of the k-th and (k+1)-th clock signals CKVk and CKVk+1 are illustrated in solid lines. The currents CKIk and CKIk+1 of the k-th and (k+1)-th clock signals CKVk and CKVk+1 are illustrated with respect to zero static current (hereinafter, referred to as "zero value").

Referring to FIG. 8, the k-th clock signal CKVk may be applied to a plurality of first resistors R1 connected in series, and a plurality of first capacitors C1 respectively connected between the first resistors R1. The (k+1)-th clock signal CKVk+1 may be applied to a plurality of second resistors R2 connected in series, and a plurality of second capacitors C2 respectively connected between the second resistors R2.

Figure 9:
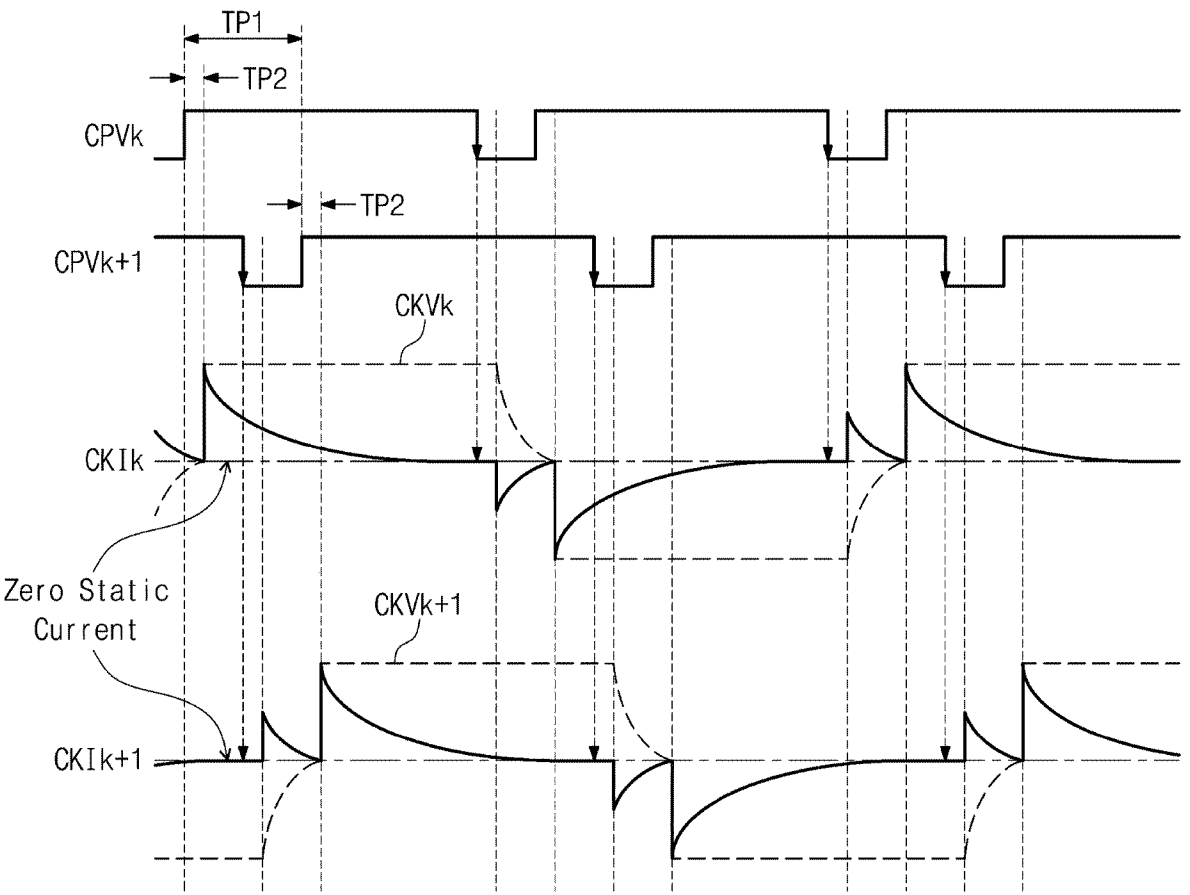
FIG. 9 is a timing diagram of the clock signals applied to the gate driver illustrated in FIG. 8 in a normal state.

The equivalent circuit illustrated in FIG. 8 is in a normal state, and in this case, the currents CKIk and CKIk+1 of the k-th and (k+1)-th clock signals CKVk and CKVk+1 may be measured while being charged and discharged as illustrated in FIG. 9.

The current CKIk of the k-th clock signal CKVk has the zero value at each falling edge of the k-th gate control clock CPVk. The current CKIk+1 of the (k+1)-th clock signal CKVk+1 has the zero value at each falling edge of the (k+1)-th gate control clock CPVk+1. Similarly, currents of other control clocks CK may have the zero value at each falling edge of the respective gate control clocks CPV.

In this case, because a static current is not detected by the static current detector 162, the error counter 163 does not perform a counting operation. Accordingly, the control clocks CK may normally be provided to the gate driver 150.

Figure 10:
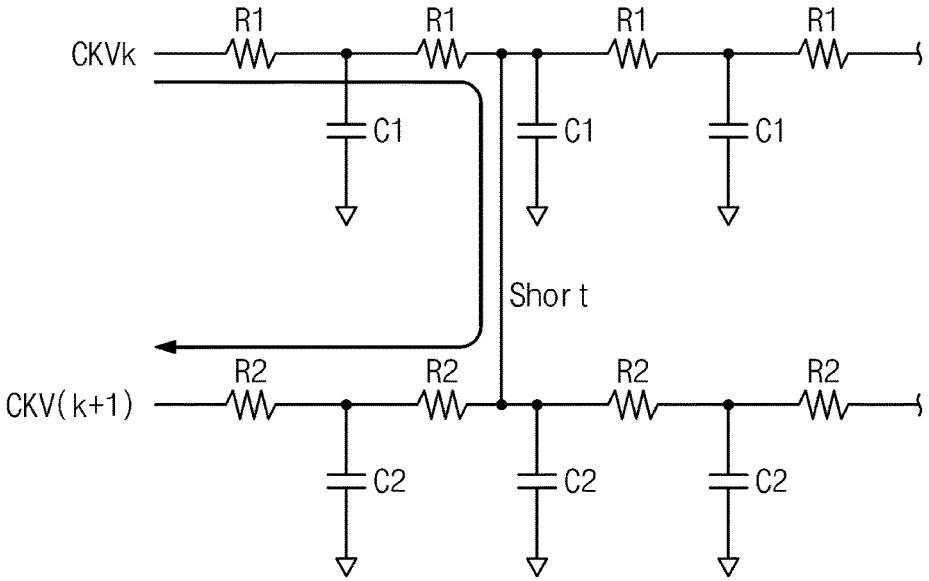
FIG. 10 illustrates a short circuit state in the internal equivalent circuit illustrated in FIG. 8.

FIG. 10 illustrates a short circuit state in the internal equivalent circuit illustrated in FIG. 8. FIG. 11 is a timing diagram of the clock signals applied to the gate driver in the internal equivalent circuit in the short circuit state illustrated in FIG. 10.

Referring to FIG. 10, a line (hereinafter, referred to as "first line") to which the k-th clock signal CKVk is applied, and another line (hereinafter, referred to as "second line") to which the (k+1)-th clock signal CKVk+1 is applied may be short-circuited. In this case, a static current having a predetermined direct current level may flow in the first line and the second line that have short-circuited. Accordingly, the current CKIk of the k-th clock signal CKVk and the current CKIk+1 of the (k+1)-th clock signal CKVk+1 may include the static current having the predetermined level.

When there is a potential difference between the k-th clock signal CKVk and the (k+1)-th clock signal CKVk+1, a current may flow in the short circuit state, and when there is no potential difference between the k-th clock signal CKVk and the (k+1)-th clock signal CKVk+1, the current does not flow even in the short circuit state.

Figure 11:
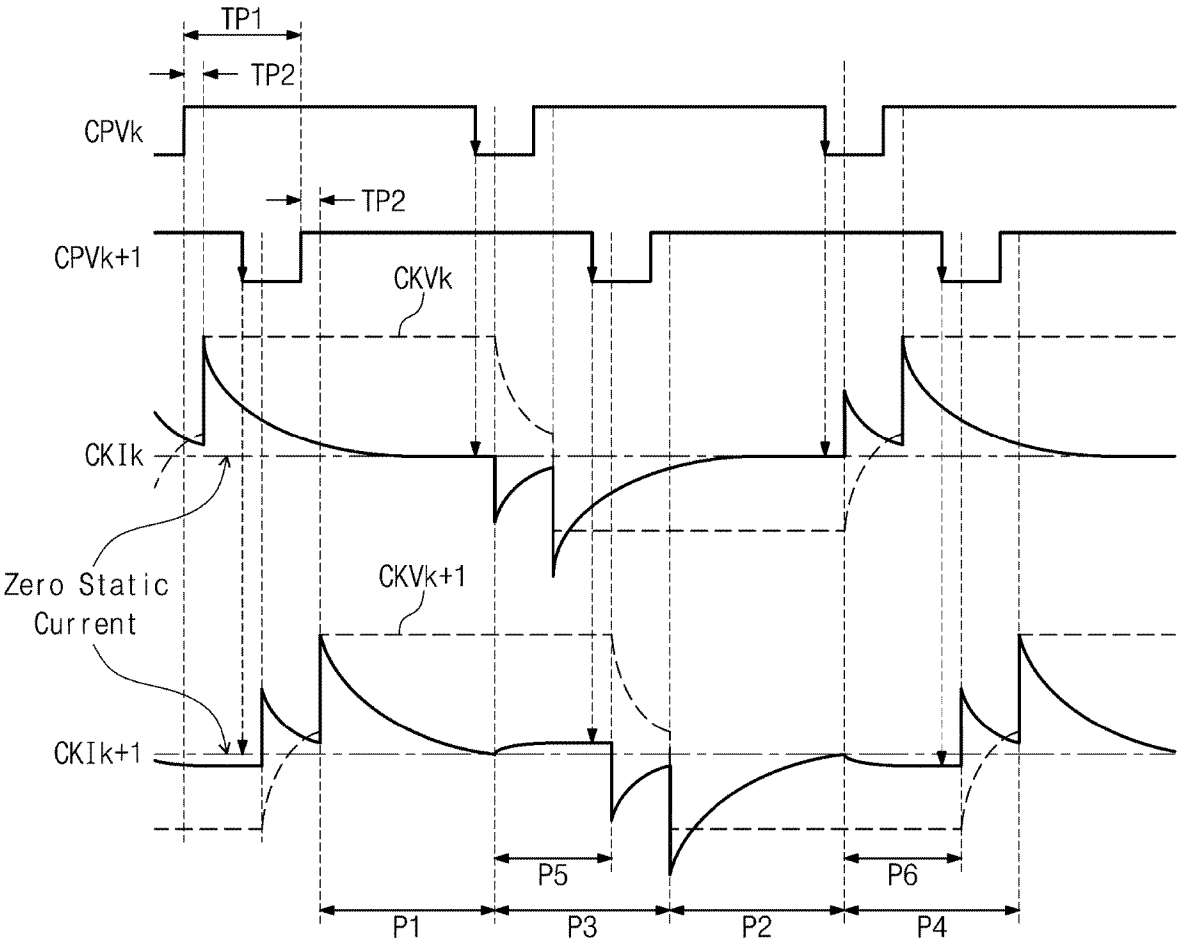
FIG. 11 is a timing diagram of the clock signals applied to the gate driver in the internal equivalent circuit in the short circuit state illustrated in FIG. 10.

Referring to FIG. 11, a period of time in which both the k-th clock signal CKVk and the (k+1)-th clock signal CKVk+1 have a high level is defined as a first period of time P1. A period of time in which both the k-th clock signal CKVk and the (k+1)-th clock signal CKVk+1 have a low level is defined as a second period of time P2.

Because there is no potential difference between the k-th clock signal CKVk and the (k+1)-th clock signal CKVk+1 in the first period of time P1 and the second period of time P2, a static current may not flow even in the short circuit state, and the currents CKIk and CKIk+1 may be discharged to the zero value. In this case, the current CKIk of the k-th clock signal CKVk may have the zero value at each falling edge of the k-th gate control clock CPVk.

A period of time in which the level of the k-th clock signal CKVk is lower than the level of the (k+1)-th clock signal CKVk+1 is defined as a third period of time P3. A period of time in which the level of the k-th clock signal CKVk is higher than the level of the (k+1)-th clock signal CKVk+1 is defined as a fourth period of time P4. A static current having a predetermined direct current level may flow in the first and second lines in the third period of time P3 and the fourth period of time P4.

In a fifth period of time P5, of the third period of time P3, in which the (k+1)-th clock signal CKVk+1 maintains the high level, the static current flowing due to the short circuit state may be measured as the current CKIk+1 of the (k+1)-th clock signal CKVk+1. Additionally, in a sixth period of time P6, of the fourth period of time P4, in which the (k+1)-th clock signal CKVk+1 maintains the low level, the static current according to the short circuit state may be measured as the current CKIk+1 of the (k+1)-th clock signal CKVk+1.

Each falling edge of the (k+1)-th gate control clock CPVk+1 overlaps the fifth period of time P5 or the sixth period of time P6. Accordingly, at each falling edge of the (k+1)-th gate control clock CPVk+1, the static current of the (k+1)-th clock signal CKVk+1 having the predetermined level may be detected.

The static current detector 162 may detect the static current of the (k+1)-th clock signal CKVk+1, and the error counter 163 may count the detection of the static current. By such an operation, the static current of the (k+1)-th clock signal CKVk+1 may be detected at each falling edge of the (k+1)-th gate control clock CPVk+1, and the short circuit state may be determined.

A current that is a normal state current with the static current added may be measured as the current CKIk+1 of the (k+1)-th clock signal CKVk+1 in the third period of time P3 except the fifth period of time P5, and the fourth period of time P4 except the sixth period of time P6.

Figure 12:
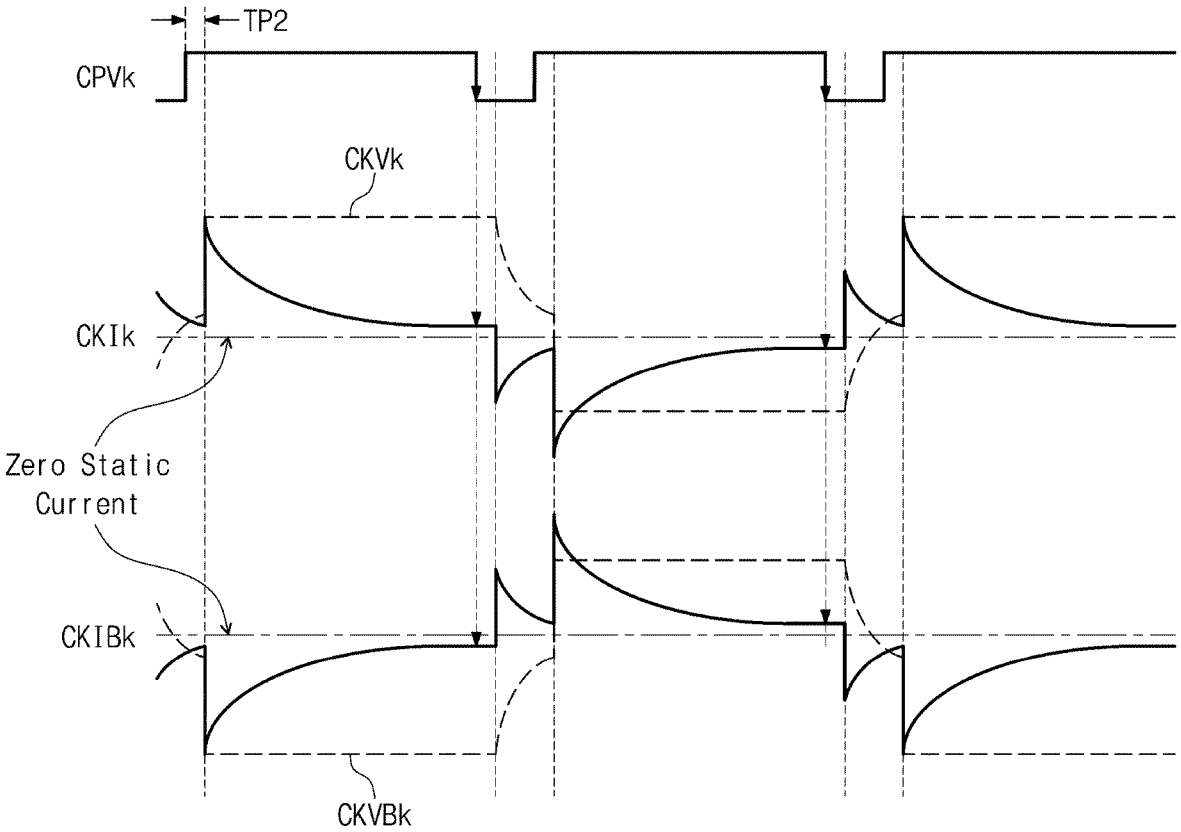
FIG. 12 is a timing diagram of control clocks having phases opposite to each other in an exemplary case that a short circuit occurs in lines to which the control clocks having the phases opposite to each other are applied.

FIG. 12 is a timing diagram of control clocks having phases opposite to each other in an exemplary case that a short circuit occurs in lines to which the control clocks having the phases opposite to each other are applied.

The current CKIk of the k-th clock signal CKVk and a current CKIBk of the k-th clock bar signal CKVBk are illustrated in FIG. 12 by way of example.

Referring to FIG. 12, a static current may flow in a time period in which there is a potential difference between the k-th clock signal CKVk and the k-th clock bar signal CKVBk. Accordingly, the current CKIk of the k-th clock signal CKVk and the current CKIBk of the k-th clock bar signal CKVBk may include the static current, and the static current of the k-th clock signal CKVk and the static current of the k-th clock bar signal CKVBk may be detected at each falling edge of the k-th gate control clock CPVk.

An example of detecting the static currents of the k-th clock signal CKVk, the (k+1)-th clock signal CKVk+1, and the k-th clock bar signal CKVBk is described, however, it is noted that the static currents of other control clocks CK may be detected in the same manner without deviating from the scope of the present disclosure.

Figure 13:
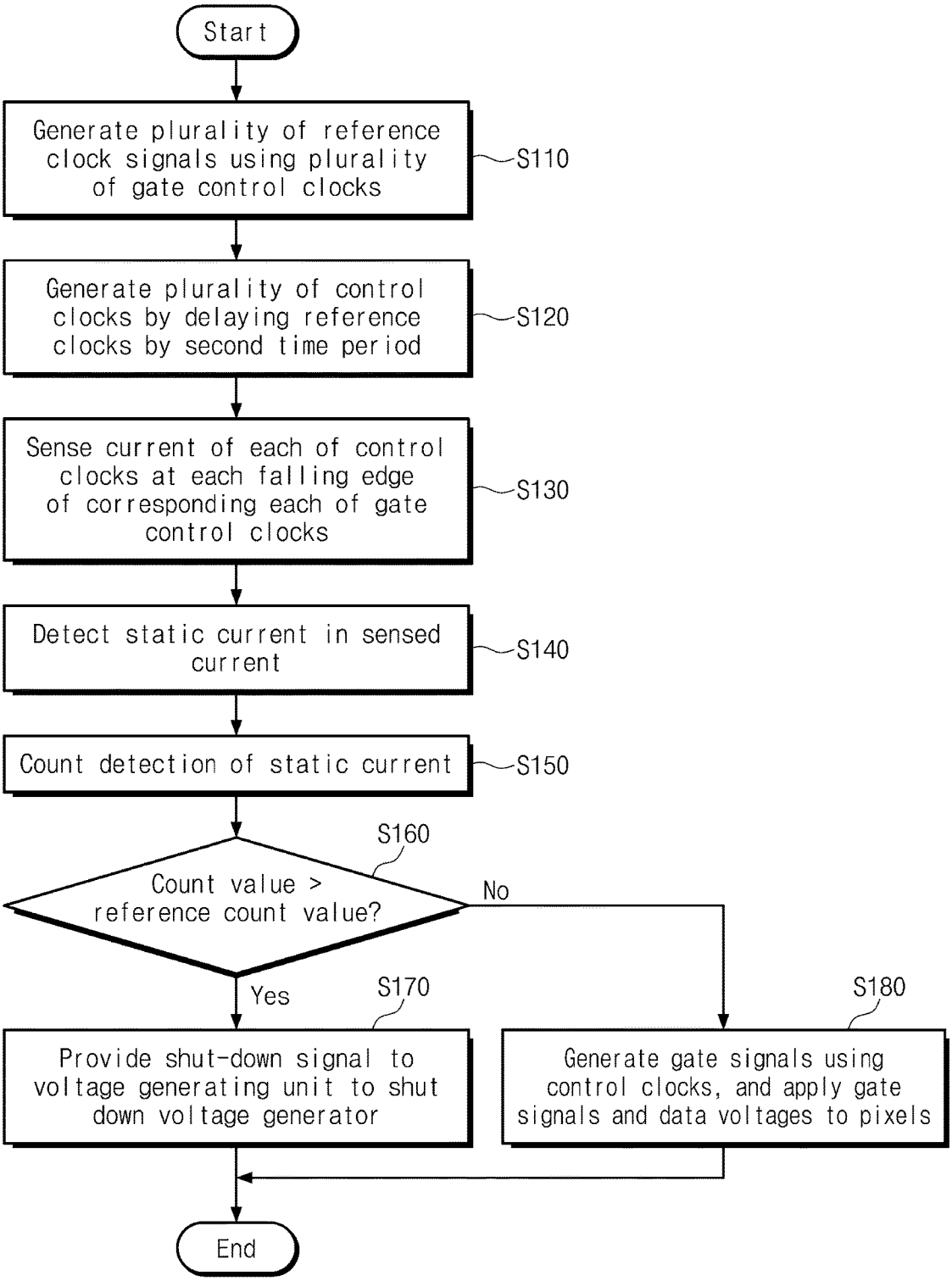
FIG. 13 is a flow chart illustrating a driving method of a display apparatus, according to one embodiment of the present disclosure.

FIG. 13 is a flow chart illustrating a driving method of a display apparatus, according to one embodiment of the present disclosure.

Referring to FIG. 13, a plurality of reference clocks RCK are generated using a plurality of gate control clocks CPV in step S110. In step S120, a plurality of control clocks CK are generated by delaying the reference clocks RCK by a second time period TP2. As described above, a (k+1)-th gate control clock CPVk+1 is a signal delayed by a first time period TP1 with respect to a k-th gate control clock CPVk.

A current CM of each of the control clocks CK is sensed at each falling edge of the corresponding gate control clocks CPV in step S130, and a static current is detected in the sensed current in step S140. When the static current is detected, the detection of static current is counted in step S150, and whether the count value is greater than a reference count value may be checked in step S160.

When the count value is greater than the reference count value, a shut-down signal is generated and provided to a voltage generator 130, and the voltage generator 130 becomes shut down, in step S170. Accordingly, the control clocks CK are not generated, and the control clocks CK are not provided to a gate driver 150. When the count value is less than or equal to the reference count value, the control clocks CK are provided to the gate driver 150, and thus gate signals are generated using the control clocks CK, and the gate signals and data voltages may be applied to pixels.

According to one embodiment of the present disclosure, a short circuit state of the gate driver 150 is detected. According to the short circuit state, the voltage generator 130 may be shut down, thereby preventing damage to components and devices of the display apparatus 100.

A display apparatus and a driving method thereof may prevent damage to components and devices of the display apparatus by measuring a static current of clock signals provided to a gate driver to detect a short circuit state of the gate driver, and by shutting down a voltage driving unit according to the short circuit state.

Although the exemplary embodiments of the present disclosure have been described herein, it is understood that various changes and modifications can be made by those skilled in the art within the spirit and scope of the present disclosure defined by the following claims or their equivalents. Also, the embodiments disclosed in the present disclosure are not intended to limit the scope of the present disclosure, and all technical scopes within the following claims and their equivalents should be interpreted to be included in the scope of the present disclosure.

What is claimed is:

1. A display apparatus comprising:

a plurality of pixels configured to receive a plurality of gate signals, and a plurality of data voltages;

a level shifter configured to receive a gate driving voltage and a plurality of gate control clocks to generate a plurality of reference clocks, and configured to generate a plurality of control clocks by delaying the plurality of reference clocks by a predetermined time period to generate a plurality of control clocks;

a gate driver configured to output the plurality of gate signals in response to the plurality of control clocks;

a short circuit protector configured to sense a current of each of the control clocks at each falling edge of each of the plurality of gate control clocks to detect a static current of each of the plurality of control clocks, and configured to output a shut-down signal based on a count value by counting the detection of the static current of each of the plurality of control clocks; and a voltage generator configured to provide the gate driving voltage to the level shifter, and shut down in response to the shut-down signal.

2. The display apparatus of claim 1, wherein the short circuit protector outputs the shut-down signal when the count value is greater than a reference count value.

3. The display apparatus of claim 1, wherein a (k+1)-th gate control clock is a signal that is a k-th gate control clock delayed by a first time period, the k-th gate control clock has a first period, and the k is a natural number.

4. The display apparatus of claim 3, wherein the period of a k-th reference clock is set to a second period that is twice of the first period, a rising edge of the k-th reference clock is synchronously set to a p-th rising edge of the k-th gate control clock, and a falling edge of the k-th reference clock is synchronously set to a (p+1)-th rising edge of the k-th gate control clock.

5. The display apparatus of claim 4, wherein a k-th control clock is generated by delaying the k-th reference clock by a second time period, and the second time period is greater than zero and less than one-fifth of an activated time period of the k-th gate control clock.

6. The display apparatus of claim 5, wherein the second time period is set to 100 ns.

7. The display apparatus of claim 5, wherein the level shifter comprises:

a clock generator configured to receive the gate driving voltage and the gate control clocks to generate the reference clocks; and a clock delayer configured to delay the reference clocks by the second time period to generate the control clocks.

8. The display apparatus of claim 5, wherein the short circuit protector comprises:

a current sensor configured to receive the gate control clocks, and sense the current of each of the control clocks at the falling edge of corresponding each of the gate control clocks;

a static current detector configured to detect the static current in the sensed current;

an error counter configured to count the detection of the static current, and output a short circuit signal when the count value is greater than the reference count value; and a short circuit determiner configured to output the shut-down signal in response to the short circuit signal.

9. The display apparatus of claim 8, wherein each of the reference clocks comprises:

a plurality of reference clock signals generated by the gate control clocks; and a plurality of reference clock bar signals generated by the gate control clocks, and having phases respectively opposite to phases of the reference clock signals, and each of the control clocks comprises:

a plurality of clock signals generated by delaying the reference clock signals by the second time period; and a plurality of clock bar signals generated by delaying the reference clock bar signals by the second time period.

10. The display apparatus of claim 9, wherein the current sensor senses a current of a k-th clock signal and a current of a k-th clock bar signal at each falling edge of the k-th gate control clock.

11. The display apparatus of claim 9, wherein, when a count value by counting detection of the static current of at least one of the clock signals and the clock bar signals is greater than the reference count value, the short circuit determiner outputs the shut-down signal.

12. The display apparatus of claim 8, wherein the error counter is configured to receive a start signal pulse for driving the gate driver, reset the count value in response to the start signal pulse, and perform the counting.

13. A driving method of a display apparatus comprising:

generating a plurality of reference clocks using a gate driving voltage and a plurality of gate control clocks;

generating a plurality of control clocks by delaying the reference clocks by a predetermined time period;

sensing a current of each of the control clocks at each falling edge of each of the gate control clocks;

detecting a static current in the sensed current;

counting the detection of the static current when the static current is detected;

shutting down a voltage generator for generating the gate driving voltage when the count value is greater than a reference count value; and generating a plurality of gate signals using the control clocks, and applying the gate signals and a plurality of data voltages to pixels, when the count value is less than or equal to the reference count value.

14. The driving method of a display apparatus of claim 13, wherein a (k+1)-th gate control clock is a signal that is a k-th gate control clock delayed by a first time period, the k-th gate control clock has a first period, and the k is a natural number.

15. The driving method of a display apparatus of claim 14, wherein the period of a k-th reference clock is set to a second period that is twice of the first period, a rising edge of the k-th reference clock is synchronously set to a p-th rising edge of the k-th gate control clock, and a falling edge of the k-th reference clock is synchronously set to a (p+1)-th rising edge of the k-th gate control clock.

16. The driving method of a display apparatus of claim 15, wherein a k-th control clock is generated by delaying the k-th reference clock by a second time period, and the second time period is greater than zero, and less than one-fifth of an activated time period of the k-th gate control clock.

17. The driving method of a display apparatus of claim 16, wherein each of the reference clocks comprises:

a plurality of reference clock signals generated by the gate control clocks; and a plurality of reference clock bar signals generated by the gate control clocks, and having phases respectively opposite to phases of the reference clock signals, and each of the control clocks comprises:

a plurality of clock signals generated by delaying the reference clock signals by the second time period; and a plurality of clock bar signals generated by delaying the reference clock bar signals by the second time period.

18. The driving method of a display apparatus of claim 17, wherein a current of a k-th clock signal and a current of a k-th clock bar signal are sensed at each falling edge of the k-th gate control clock.

19. The driving method of a display apparatus of claim 17, wherein, when a count value by counting detection of the static current of at least one of the clock signals and the clock bar signals is greater than the reference count value, the voltage generator becomes shut down.

20. The driving method of a display apparatus of claim 13, wherein the counting of the detection of the static current comprises resetting the count value in response to a start signal pulse and performing the counting.

* * * * *